US005531428A

United States Patent [19]

Dembicks et al.

[11] Patent Number: 5,531,428

[45] Date of Patent: Jul. 2, 1996

[54] ADJUSTABLE CLOSURE FORCE CONTROL DEVICE FOR A BENCH VISE AND METHOD

[76] Inventors: Andrew E. Dembicks, 5308 Boca Marina Cir. North, Boca Raton, Fla. 33487; James E. Herrmann, 1208 Fairfax Dr., Raleigh, N.C. 27609

[21] Appl. No.: 358,809

[22] Filed: Dec. 19, 1994

[51] Int. Cl.[6] ..... B25B 1/02

[52] U.S. Cl. ..... 269/172; 269/208; 269/247; 269/329; 81/429

[58] Field of Search ..... 81/429, 469; 269/172, 269/246, 247, 329, 165, 240, 243, 245, 254 R, 207, 208

[56] References Cited

U.S. PATENT DOCUMENTS

| | | | |
|---|---|---|---|
| 2,313,361 | 3/1943 | Richards . | |
| 2,366,263 | 1/1945 | Husted . | |
| 2,373,812 | 4/1945 | Coop . | |
| 2,701,478 | 2/1955 | Riess . | |
| 2,745,303 | 5/1956 | Cornelius . | |
| 3,147,002 | 9/1964 | Arnold | 269/24 |
| 3,578,308 | 5/1971 | Jesionowski | 269/254 |
| 4,046,364 | 9/1977 | Coope et al. . | |
| 4,809,962 | 3/1989 | Lee | 269/182 |
| 4,995,599 | 2/1991 | Pfluger | 269/207 |
| 5,098,073 | 3/1992 | Lenz | 269/154 |
| 5,110,100 | 5/1992 | Cotton . | |
| 5,192,062 | 3/1993 | Berchtold . | |

*Primary Examiner*—Bruce M. Kisliuk
*Assistant Examiner*—Thomas W. Lynch
*Attorney, Agent, or Firm*—Bell, Seltzer, Park & Gibson

[57] ABSTRACT

The invention discloses an adjustable closure force control device for a screw-type vise and a method for selectively controlling the closure force of the vise. The control device uses a nut barrel for threadingly receiving a screw of a screw-type vise with a movable vise jaw being operatively connected to the screw so that advancement of the screw through the nut barrel results in vise jaw closure about an article to be held. The closure force control selectively controls the advancement of the screw through the nut barrel in response to the resistance to movement encountered by the movable vise jaw. In a preferred form of the invention, a compressible detent plunger cooperates with a series of apertures spaced about the nut barrel periphery. This allows the nut barrel to rotate with the screw, ending screw advancement and jaw closure despite continued screw rotation, when the predetermined resistance to jaw movement is encountered. The closure force control can be selectively overridden allowing the vise to perform in a direct operating mode, similar to that of conventional vises.

18 Claims, 3 Drawing Sheets

ADJUSTABLE CLOSURE FORCE CONTROL DEVICE FOR A BENCH VISE AND METHOD

FIELD OF THE INVENTION

The present invention relates to the field of vises, and, more particularly, a closure force control device for a bench-type vise and a vise incorporating a closure force control device.

BACKGROUND OF THE INVENTION

Vises have been known in the art as a common means for holding articles in a stationary position while they are being worked on, treated or repaired. For example, such vises are disclosed in U.S. Pat. Nos. 2,313,361 and 4,046,364.

Typically, an article to be held in the vise is placed between a pair of jaws, wherein one of the jaws is stationary and the other jaw is movable relative to the stationary jaw so as to tighten the jaws around the article. However, because articles to be held in the vise are often fragile, it has been difficult with prior art vises to attain the desired degree of jaw closure or clamping force, that is, to tighten the jaws sufficiently to hold the article steady without overtightening and damaging the article.

Several attempts have been made to overcome this problem of overtightening. For example, U.S. Pat. No. 5,110,100 to Cotton discloses a vise designed to prevent excessive clamping force by providing a one-way slip clutch attached to a multi-part shaft. The shaft is positioned between the movable jaw and the drive mechanism for the movable jaw. The clutch is formed from two clutch halves which are biased toward each other.

Another approach for controlling the tightening force of a vise is taught by U.S. Pat. No. 4,046,364 to Coope et al. The vise of this patent utilizes clutch discs which are frictionally loaded against each other so that a predetermined amount of torque is required to cause the discs to slip relative to each other. Like the force control device of Cotton, the Coope et al device requires a multi-part rod or shaft.

Thus, a need exists for a vise having an adjustable closure force control which can be readily adjusted between a closure force limiting mode which prevents the vise jaws from crushing a held article and a direct operating mode which allows the device to operate as a conventional vise. Further, there is a need for an adjustable force control mechanism which can be readily applied to a conventional vise without requiring significant structural modifications of the vise.

SUMMARY OF THE INVENTION

In view of the foregoing background, it is therefore an object of the present invention to provide an adjustable closure force control for a vise and an associated method for preventing the crushing or damaging of an article held in the vise. It is also an object of the invention to provide an adjustable closure force control which can be readily applied to existing vises without requiring significant structural modifications to the existing vise.

These and other objects, features, and advantages of the present invention are provided by an adjustable vise having a base shaped to support the vise on a flat surface. A pair of opposing jaws are connected to the base wherein at least one of the jaws is movable relative to the other jaw by means of a rotatable threaded screw operatively connected thereto. A closure force control is attached to the housing to preferably allow selective operation of the closure force control in a direct operating mode wherein the jaw closure force directly relates to rotation of the screw and a closure force limiting mode wherein a predetermined maximum or threshold jaw closure or clamping force is selected such that rotation of the screw causes movement of one jaw relative to the other jaw only until the maximum jaw closure force is attained thus preventing damage to an article held between the pair of jaws.

The adjustable closure force control preferably includes a nut barrel which has a threaded bore for threadingly receiving a cooperatively threaded screw of the vise. To advance the screw through the nut barrel and thereby selectively advance a movable vise jaw relative to the other vise jaw it is beneficial to selectively adjustably inhibit the rate of rotation of the nut barrel relative to the screw. In this way, both advancement of the screw and jaw closure force can be selectively and adjustably controlled.

In a preferred embodiment of the invention, the nut barrel includes a series of apertures located spacially about the nut barrel periphery. A detent plunger is located such that its longitudinal axis extends substantially transverse to the axis of rotation of the screw and the nut barrel. The detent plunger is designed to be selectively received by the apertures of the nut barrel, and includes means for affecting its position with respect to the nut barrel.

An adjustment knob is preferably provided for affecting the position of the detent plunger. The adjustment knob has an inclined bottom surface which contacts the detent plunger so that rotation of the adjustment knob in one direction causes the detent plunger to be moved toward the nut barrel and into one of the apertures. In this position, the detent plunger prevents rotation of the nut barrel and allows the threaded screw to advance relative to the nut barrel in a manner consistent with the conventional operation of a vise. Rotation of the adjustment knob in the other direction allows the detent plunger to move away from the nut barrel, thereby allowing the nut barrel to rotate whenever the closure or clamping force caused by the jaws exceeds the combined frictional force between the nut barrel, the detent plunger and the threaded screw.

The detent plunger includes a spring so that it is longitudinally compressible. When the adjustment knob is turned so that the detent plunger slightly extends into an aperture of the nut barrel, the nut barrel is initially held from rotating in response to rotation of the vise screw. The screw can then advance through the nut barrel and the movable vise jaw closes about the article to be held. However, once the jaws meet a predetermined level of resistance to closure i.e., the predetermined maximum jaw closure force, due to their contact with the held article, the detent plunger longitudinally compresses and is forced out of the nut barrel aperture, allowing the nut barrel to rotate with the screw. Because the nut barrel now turns with the screw, the screw does not advance through the nut barrel and the jaws do not crush the article being held. This orientation of the nut barrel and detent plunger provides the closure force limiting mode of the invention.

The predetermined level for force transfer from the jaws to the nut barrel is determined by the extent to which the detent plunger extends into the nut barrel aperture. The detent plunger may selectively be extended into the aperture to an extent sufficient to prevent force transfer and thus provide a direct operating mode. In the direct operating mode, the vise performs in a manner similar to that of a conventional vise. Thus, the arrangement of the nut barrel and detent plunger in the present invention allows a user to selectively utilize the closure force limiting mode or the direct operating mode.

It will be noted that other means for slowing nut barrel rotation relative to screw rotation while maintaining the screw rotation may also be utilized, as will be discussed more fully herein.

DETAILED DESCRIPTION OF THE PREFERRED EMBODIMENTS

Figure 1:
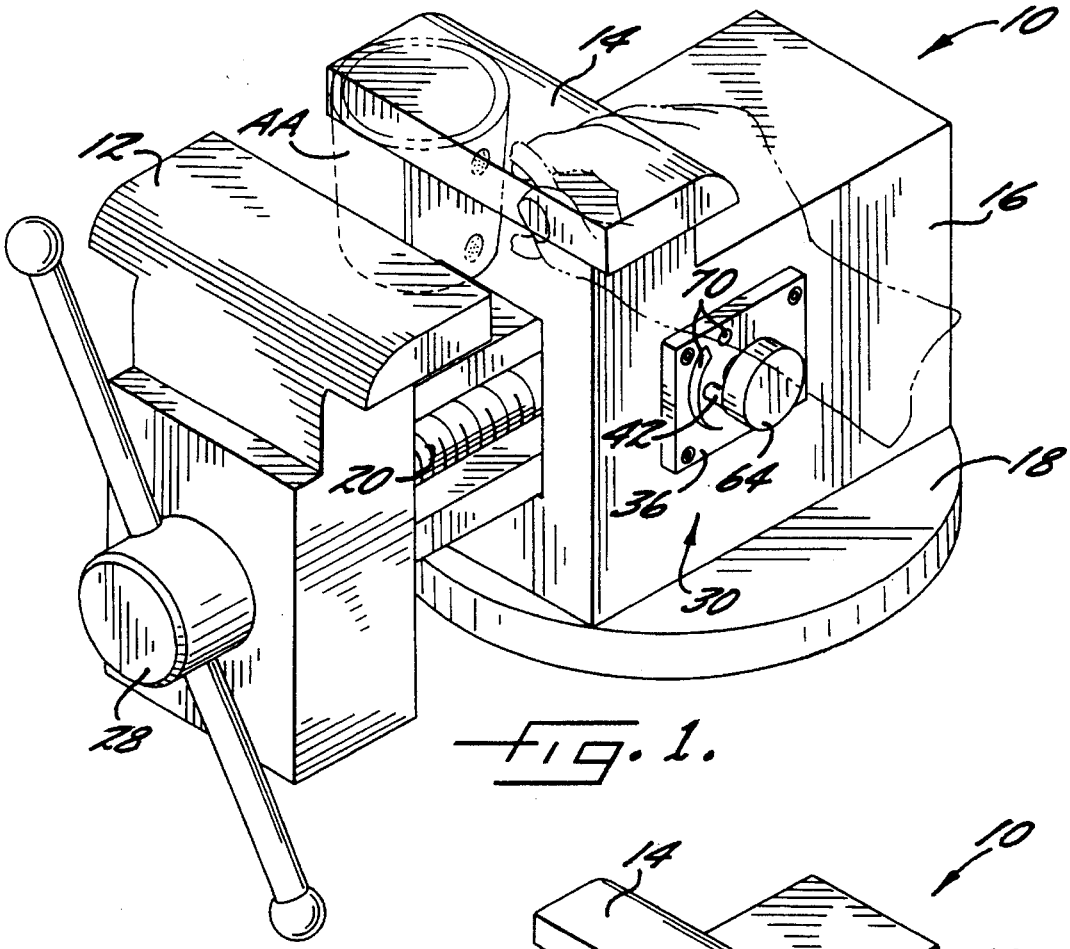
FIG. 1 is a perspective view of a vise in accordance with the present invention.

The present invention now will be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

A preferred embodiment of the invention is shown in FIGS. 1–8C. According to the illustrated embodiment, the invention comprises a conventional screw-type vise 10 having a movable first jaw 12 and a second jaw 14. The second jaw 14 is formed integrally with a housing 16. The housing 16 is attached to a base 18 which enables the vise to rest securely on a horizontal surface such as a work bench (not shown). The housing 16 can be formed as a separate piece or integrally formed with the base 18. The base 18 extends outwardly from the housing 16 in order to provide support for the vise 10 and allow it to be fastened to a surface, such as by screws, bolts or a C-clamp (not shown). Alternatively, in lieu of a base, the housing 16 may be directly fastened or secured to a support structure.

The vise 10 also includes a threaded screw 20 which extends between the first jaw 12 and the second jaw 14 and enters the housing 16 through a first housing hole 22. A cylindrical sleeve or nut barrel 24 having a threaded bore 26 is located within the housing 16 adjacent the second jaw 14 so that its threaded bore 26 is longitudinally aligned with the screw 20. The nut barrel 24 is axially fixed within the housing 16 relative to the screw 20 and selectively rotatable about its longitudinal axis.

The screw 20 is adapted to be rotated by a rotation means such as a handle 28, which is located adjacent the first jaw 12. The screw 20 is threaded through the nut barrel 24, which is located within the housing 16 so that rotation of the screw by handle 28 can cause rotation and longitudinal advancement of the screw through the nut barrel. The screw 20 is operatively connected to the first jaw 12 such that longitudinal advancement of the screw through the nut barrel 24 causes the first jaw 12 to move toward the second jaw 14 to thereby effect vise jaw closure about an article to be held, shown generally at AA.

Figure 2:
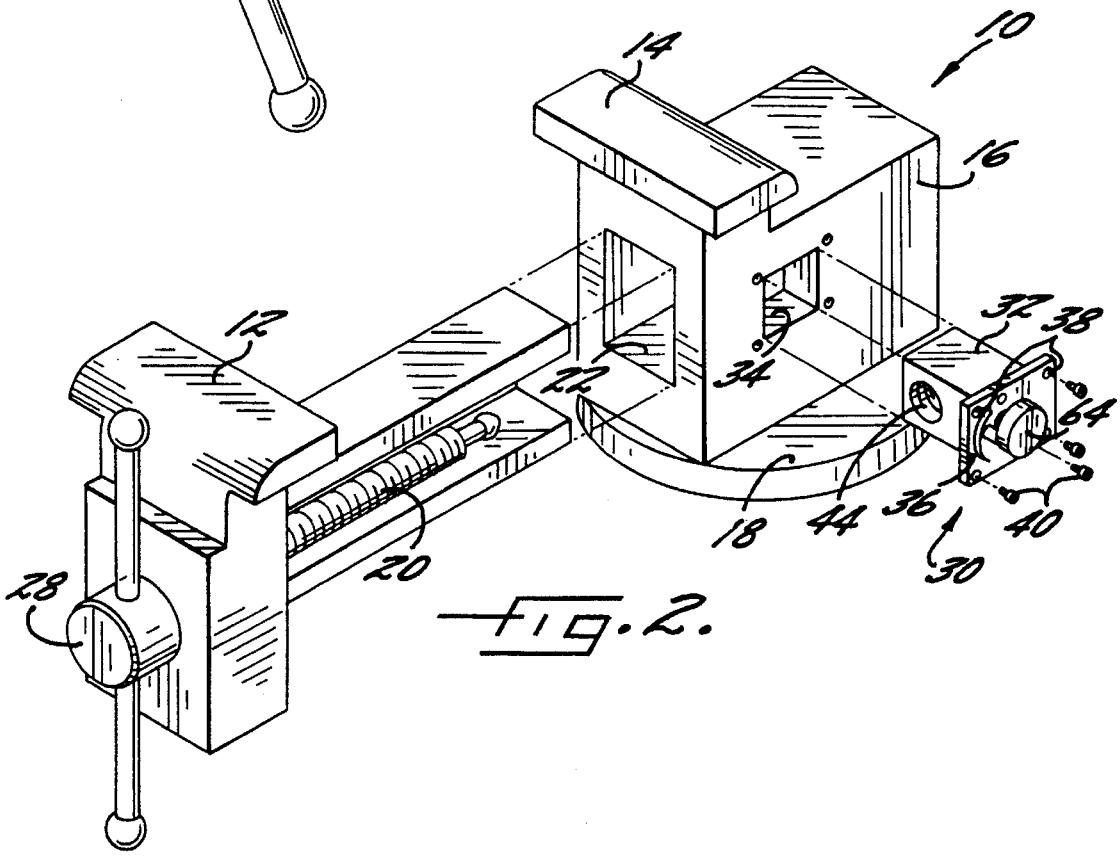
FIG. 2 is a partially exploded perspective view of a vise according to the present invention showing the movable jaw, screw and closure force control as they fit into the housing of the vise.
Figure 3:
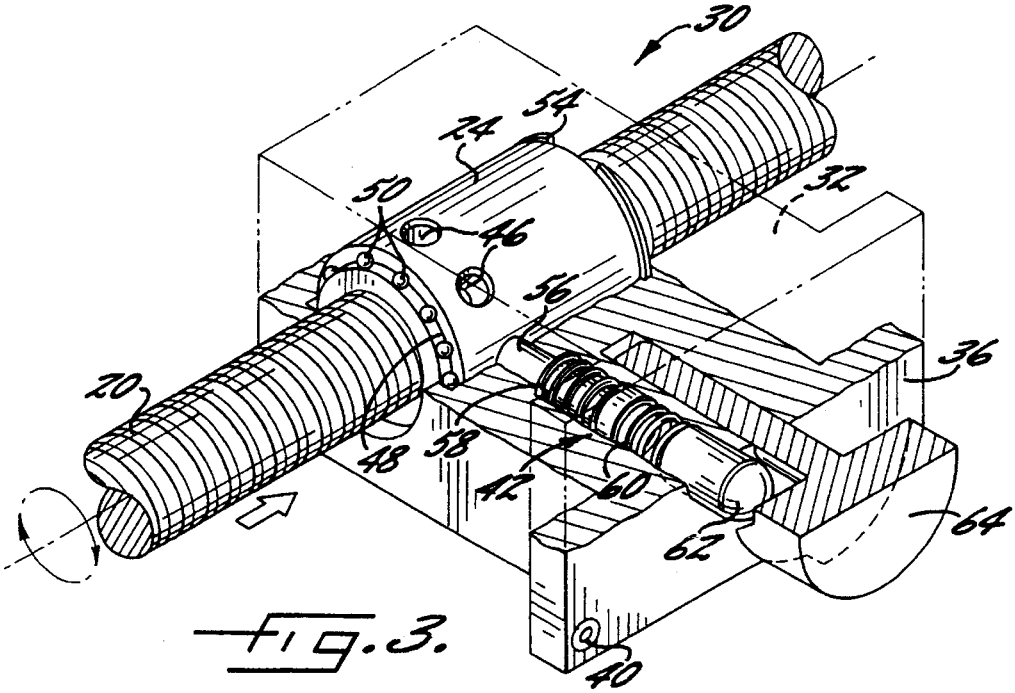
FIG. 3 is a perspective view partially in cross-section and partially in phantom showing the closure force control.
Figure 4:
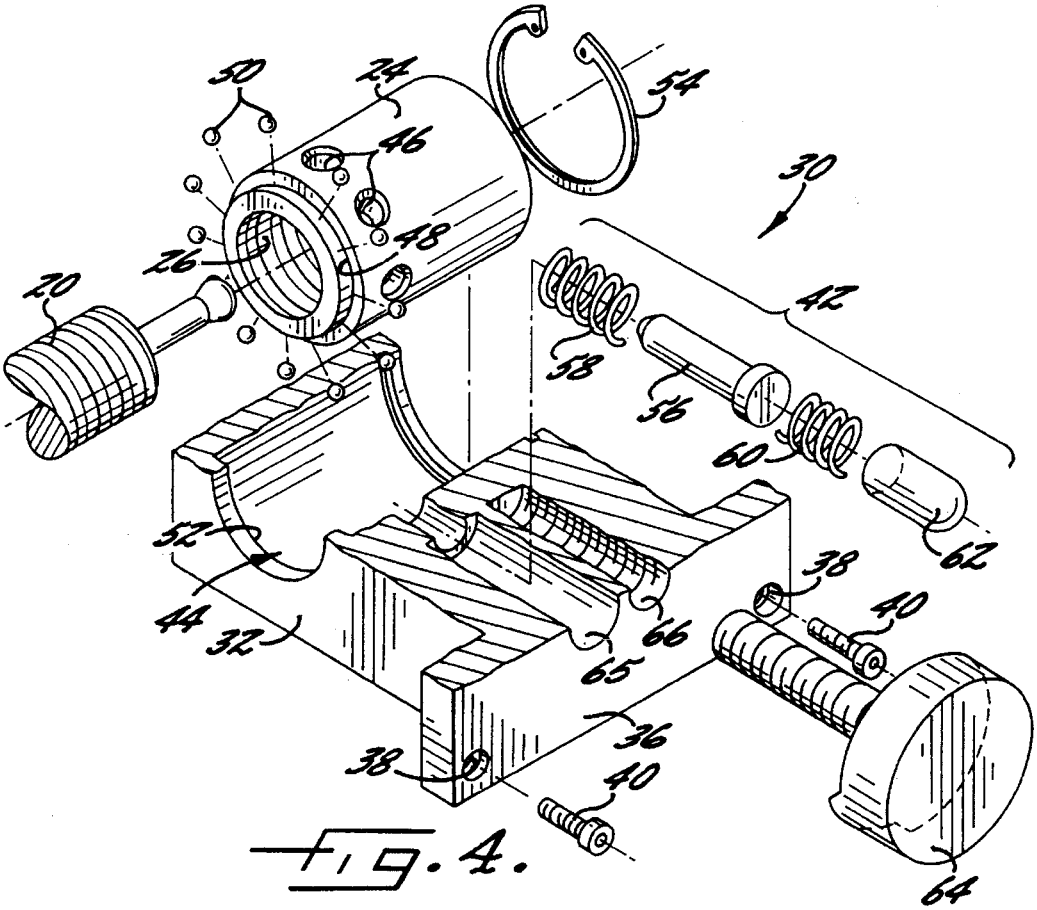
FIG. 4 is an exploded perspective view partially in cross-section of the closure force control shown in FIG. 3.

A closure force control which selectively affects the longitudinal advancement of the screw 20 through the nut barrel 24 is shown generally at 30. As shown in FIGS. 2–4, closure force control includes a control housing 32 sized to be received within a second vise housing hole 34 located adjacent the second jaw 14. The control housing 32 includes a front plate 36 which extends beyond the dimensions of the housing. The front plate 36 can be integrally formed with housing 32 or formed separately and securely attached thereto. The front plate 36 includes mounting holes 38 so that when the control housing 32 is positioned within the second vise housing hole 34, mounting screws 40 extend through the front plate holes and secure the control housing within the threaded holes in vise housing 16.

The nut barrel 24 of the closure force control 30 has a modified peripheral surface and a cooperating detent plunger assembly 42. The nut barrel 24 is located within an opening 44 in control housing 32 so that when the control housing is positioned within the second vise housing hole 34, the screw 20 is threadingly received by the nut barrel 24. The nut barrel 24 includes a plurality of apertures 46 about its periphery which are adapted to selectively receive the detent plunger assembly 42 which is positioned within control housing 32 so that its longitudinal axis extends substantially transverse to the axis of rotation of screw 20 and nut barrel 24. The cross-sectional shape of each of the apertures 46 is circular in order to accommodate a substantially cylindrically shaped detent plunger. It is to be understood that the cross-sectional shape of the apertures 46 may vary to accommodate a detent plunger assembly 42 with a different shape.

The nut barrel 24 also includes a ridge 48 along its periphery help to maintain the nut barrel within the control housing 32 such that it can freely rotate therein. The closure force control 30 has a number of rotation facilitators, such as ball bearings 50, seated on the ridge 48 between an edge 52 of housing opening 44 to facilitate rotation of the nut barrel 24 within the control housing 32. In addition, a lubricant (not shown) may be included to reduce friction between the nut barrel and the housing to enhance nut barrel rotation. A retaining ring 54 is provided to maintain the nut barrel 24 in its desired position within the control housing 32 and allow it to freely rotate within that position.

The detent plunger assembly 42 is made up of first and second plunger elements 56 and 62, and first and second spring elements 58 and 60. The first spring 58 biases first plunger element away from the nut barrel 24. The second spring 60 is located between first and second plunger elements 56 and 62 and allows longitudinal compression of the detent plunger. Further, though illustrated as being substantially cylindrical, the individual plunger elements may be formed in a variety of shapes.

The detent plunger assembly 42 is longitudinally movable within the control housing 32 so that the detent plunger can be selectively moved toward and away from the nut barrel 24. The detent plunger assembly 42 is positioned in a desired position with respect to the nut barrel 24 by way of an adjustment knob 64, which is seated in a threaded opening 66 in the control housing 32 adjacent the detent plunger.

Figure 5:
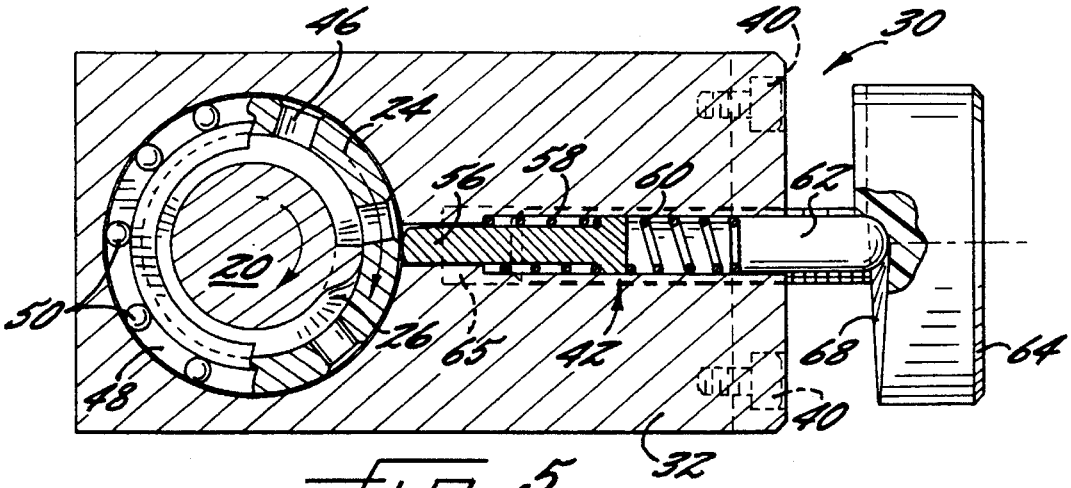
FIG. 5 is a partially cross-sectional view of the closure force control positioned in the closure force limiting mode.
Figure 6:
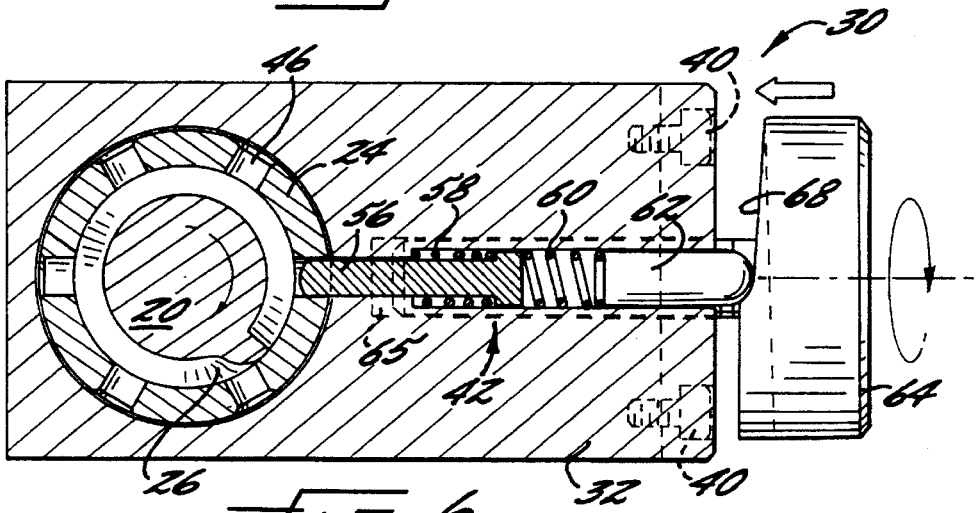
FIG. 6 is a partially cross-sectional view of the closure force control positioned in the direct operating mode.
Figure 7A:
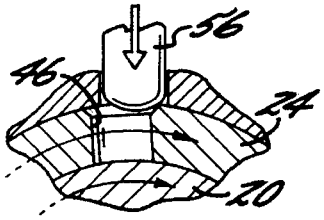
FIGS. 7A–7C show sectional views of the nut barrel and detent plunger in closure force limiting mode.
Figure 7B:
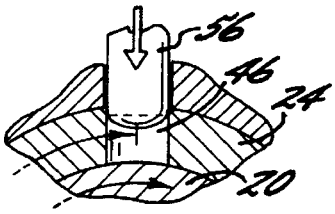
Figure 7C:
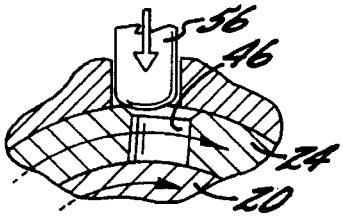
Figure 8A:
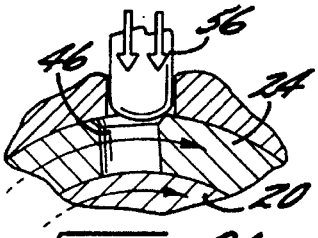
FIGS. 8A–8C show cross-sectional views of a portion of the nut barrel and a portion of the detent plunger being set in the closure force limiting mode.
Figure 8B:
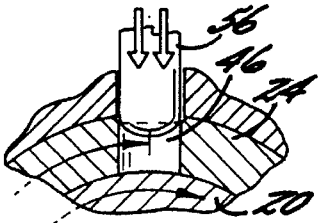
Figure 8C:
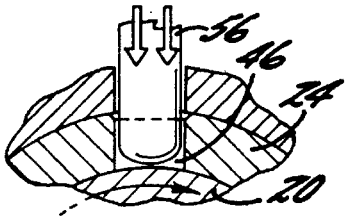

The adjustment knob 64 has an inclined bottom surface 68 which contacts the detent plunger assembly 42, as shown more specifically in FIGS. 5 and 6, to thereby position the detent plunger. As the adjustment knob 64 is rotated and the detent plunger assembly 42 contacts the adjustment knob along a higher point of incline, the detent plunger is pushed toward the nut barrel 24. Similarly, when the adjustment knob 30 is rotated in the reverse direction so that the detent plunger assembly 42 contacts the adjustment knob 64 along a lower point of incline, the detent plunger moves away from the nut barrel 24. In order that the closure force selected can be readily determined, the front plate 36 includes indexing 70 for indicating the position of the adjustment knob 64 and detent plunger assembly 42. The adjustable positioning of the detent plunger assembly 42 by adjustment knob 64 enables the closure force control 30 to function in two distinct operating modes: a closure force limiting mode and a direct operating mode.

In operation, the detent plunger assembly 42 is set at a desired position, depending on the amount of jaw closure force one desires to apply to an article AA to be held between jaws 12 and 14. FIGS. 5 and 7A–7C illustrate the closure force limiting mode. In this mode, the detent plunger assembly 42 is positioned so that it extends slightly into one of the nut barrel apertures 46 by turning the adjustment knob 64 so that a higher position on its inclined bottom surface 68 abuts the detent plunger assembly 42. Due to the extension of the detent plunger assembly 42 into the aperture 46, the nut barrel 24 is held as rotation of screw 20 begins. The screw 20 therefore advances through the nut barrel 24 and the first jaw 12 moves toward the second jaw 14, closing about the article AA to be held. When the predetermined amount of force is reached, i.e., when the resistance met by the jaws 12 and 14 as a result of them contacting the held article AA reaches the predetermined level, the force from the jaws is transferred to the nut barrel 24 and the detent plunger assembly 42 slips out of the aperture 46 due to compression of second spring 60. Because the nut barrel 24 is no longer being held from rotating with the screw 20, the screw no longer advances through the nut barrel. This prevents the first jaw 12 from continuing to close on the held article AA and prevents it from being crushed or damaged despite continued screw rotation. The amount of resistance required to effect force transfer can thus be readily selected based on the extent to which the detent plunger is extended into the aperture.

FIGS. 6 and 8A–8C illustrate the direct operating mode. In this mode, when the adjustment knob 64 is turned so that a greater inclined portion of the adjustment knob bottom surface 68 contacts the detent plunger assembly 42. In this position, the detent plunger assembly 42 is positioned to such an extent that the force transfer discussed above does not occur. Accordingly, upon rotating the screw to tighten about the held article AA in the manner discussed above, the detent plunger assembly 42 does not slip out of the aperture 46 when the jaws 12 and 14 meet resistance to their closing. In this mode the vise 10 performs as a conventional vise, with the nut barrel 24 continually being held stationary while the screw 20 rotates despite the opposition to jaw closure put forth by the held article AA.

Closure force control 30 is preferably provided as a single unit, as this structure allows for easy retrofitting of conventional vises. To retrofit a conventional screw-type vise 10, the screw 20 of the vise is threaded through the nut barrel 24 of the closure force control 30. The nut barrel 24 already forming part of the conventional vise can optionally be removed or be left in its position and the closure force control 30 added to the existing vise structure without modification, provided the screw 20 of the vise has sufficient length to accommodate the two nut barrels (not shown). The cooperating nut barrel 24 and detent plunger assembly 42 of the closure force control 30 then can function to selectively control the closure force of the vise jaws 12 and 14.

As one of ordinary skill in the art would readily appreciate, modified forms of some of the elements of the preferred embodiment of the invention may be used while remaining within the scope of the invention. For example, any rotation means 28 may be utilized to effect the rotation of screw 20, such as mechanical, electrical or manual means. In addition, the adjustment knob 64 can assume a variety of configurations other than that of a knob having a smooth inclined bottom surface. For example, the adjustment knob could have a stair-step type bottom surface. Likewise, other means for selectively keeping the nut barrel 24 from rotating with the screw 20 could also be used to perform the present invention. For instance, the nut barrel 24 and the detent plunger assembly 42 may have correspondingly textured surfaces which cooperate to slow the nut barrel rotation with respect to screw 20 rotation.

Further, the second jaw 14 may also be movable rather than stationary in the manner shown in FIG. 1. Thus the vise 10 could comprise two movable jaws in order to attain more rapid jaw closure about an article to be held. Also, when a stationary second jaw 14 is to be used, it is noted that other stationary objects can function as the second jaw, provided that the object is capable of cooperating with the first movable jaw 12 to hold and support an article. For example, the movable jaw 12 and closure force control 30 could be used in combination with a wall for holding an article between the movable jaw and the wall.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. An adjustable vise comprising:

a housing;

a pair of opposing jaws wherein at least one of said jaws is connected to said housing;

a rotatable threaded screw operatively connected to at least one of said jaws for causing movement of said at least one jaw relative to the other of said jaws responsive to rotation of said screw to thereby facilitate holding and release of an article positioned between said pair of jaws; and a closure force control attached to said housing for allowing selective operation of a direct operating mode wherein jaw closure force directly relates to rotation of said screw, and a closure force limiting mode wherein a predetermined maximum jaw closure force is selected, such that rotation of said screw causes movement of said jaw relative to the other of said jaws only until the maximum jaw closure force is attained, thereby preventing damage to an article held between said pair of jaws.

2. An adjustable vise according to claim 1, said closure force control comprises a nut barrel threadingly received on said screw and a detent plunger for cooperating with said nut barrel to control rotation of said nut barrel in response to rotation of said screw.

3. An adjustable vise according to claim 2, wherein said nut barrel comprises a plurality of apertures about its periphery which are adapted to selectively receive said detent plunger.

4. An adjustable vise according to claim 3, wherein said closure force limiting mode comprises positioning said detent plunger such that it partially enters an aperture in said nut barrel such that when said predetermined maximum jaw closure force is attained, said detent plunger slips out of said aperture allowing said nut barrel to rotate along with said screw.

5. An adjustable vise according to claim 3, further comprising an adjustment knob for positioning said detent plunger with respect to said nut barrel.

6. An adjustable vise according to claim 5, wherein said adjustment knob is located adjacent said detent plunger such that a bottom surface of said adjustment knob contacts said detent plunger, said bottom surface being inclined so that movement of said adjustment knob affects the position of said detent plunger with respect to said nut barrel.

7. An adjustable vise according to claim 6, further comprising indexing for indicating the position of said adjustment knob along its path of movement.

8. An adjustable vise according to claim 2, wherein said detent plunger comprises first and second plunger elements and a spring connecting said first plunger element to said second plunger element enabling said first plunger element to compress longitudinally relative to said second plunger element in response to rotation of said nut barrel.

9. An adjustable vise comprising:

a housing;

a pair of opposing jaws, wherein at least one of said jaws is connected to said housing;

a rotatable screw operatively connected to at least one of said jaws for causing movement of said at least one jaw relative to the other of said jaws responsive to rotation and advancement of said screw;

a nut barrel located within said housing, said nut barrel having a bore containing threads sized to cooperate with said screw enabling said screw to selectively advance relative to said nut barrel; and means for adjustably limiting the advancement of said screw relative to said nut barrel while maintaining screw rotation, thereby controlling the corresponding amount of force applied by said pair of jaws to prevent damaging of an article held therebetween.

10. An adjustable vise according to claim 9, wherein said means for limiting the advancement of said screw relative to said nut barrel while maintaining screw rotation comprises a detent plunger and a plurality of apertures radially positioned about said nut barrel periphery which are adapted to selectively receive said detent plunger.

11. An adjustable vise according to claim 10, wherein said detent plunger includes first and second plunger elements and a spring connecting said first plunger element to said second plunger element.

12. An adjustable vise according to claim 10, further comprising an adjustment knob located adjacent said detent plunger such that a bottom surface of said adjustment knob contacts said detent plunger, wherein said bottom surface is inclined so that movement of said adjustment knob affects the position of said detent plunger with respect to said nut barrel.

13. An adjustable vise according to claim 12, further comprising indexing for indicating the position of said adjustment knob along its path of movement.

14. A closure force control apparatus for use with a vise having a housing, a pair of opposed jaws, and a rotatable screw operatively connected between said pair of jaws for causing movement of one of said jaws relative to the other, said apparatus comprising:

a control housing for positioning within the vise housing, said control housing defining a first opening for longitudinal alignment with the screw, and said control housing defining a second opening oriented generally transverse to said first opening;

a nut barrel positioned within said first opening, said nut barrel having a threaded bore sized to threadingly receive the screw, enabling said nut barrel to selectively rotate with the screw, and said nut barrel defining a plurality of apertures radially positioned about its periphery; and a detent plunger adjustably positionable within said second opening and movable relative to said nut barrel to control rotation of said nut barrel in response to rotation of the screw when threaded through said nut barrel, said detent plunger being movable between a first position which does not allow rotation of the nut barrel in response to rotation of the screw and a second position allowing rotation of said nut barrel with rotation of the screw.

15. A closure force control apparatus according to claim 14, wherein said control housing comprises a third opening and an adjustment knob received within said third opening, said adjustment knob cooperating with said detent plunger to determine the position thereof with respect to said nut barrel.

16. A closure force control apparatus according to claim 15, wherein said adjustment knob is located adjacent to said detent plunger such that a bottom surface of said adjustment knob contacts said detent plunger and said bottom surface being inclined so that movement of said adjustment knob affects the position of said detent plunger with respect to said nut barrel.

17. An adjustable vise comprising:

a housing;

a pair of opposing jaws, wherein at least one of said jaws is connected to said housing;

a rotatable screw operatively connected to at least one of said jaws and selectively advanceable relative to the other of said jaws for causing movement of said at least one jaw relative to the other of said jaws responsive to rotation and advancement of said screw; and force control means for adjustably limiting advancement of said screw relative to said at least one of said jaws to thereby control the corresponding amount of force applied by said pair of jaws to prevent damaging of an article held therebetween.

18. An adjustable vise according to claim 17, wherein said force control means comprises a nut barrel threadingly received on said screw and a detent plunger for cooperating with said nut barrel to control rotation of said nut barrel in response to rotation of said screw.

* * * * *